US007125202B2

(12) United States Patent
Morizot et al.

(10) Patent No.: US 7,125,202 B2
(45) Date of Patent: Oct. 24, 2006

(54) STABILIZED EARTH STRUCTURE AND METHOD FOR CONSTRUCTING IT

(75) Inventors: Jean-Claude Morizot, Paris (FR); Nicolas Freitag, Orsay (FR)

(73) Assignee: Freyssinet International (Stup), Velizy cedex (FR)

( * ) Notice: Subject to any disclaimer, the term of this patent is extended or adjusted under 35 U.S.C. 154(b) by 0 days.

(21) Appl. No.: 10/731,813

(22) Filed: Dec. 9, 2003

(65) Prior Publication Data

US 2005/0079017 A1 Apr. 14, 2005

(30) Foreign Application Priority Data

Oct. 13, 2003 (FR) ..... 03 11937

(51) Int. Cl.
*E02D 29/02* (2006.01)

(52) U.S. Cl. ..... 405/262; 405/284; 405/286

(58) Field of Classification Search ..... 405/262, 405/284, 286, 285
See application file for complete search history.

(56) References Cited

U.S. PATENT DOCUMENTS

| | | | | |
|---|---|---|---|---|
| 4,343,571 A | | 8/1982 | Price | |
| 4,824,293 A | * | 4/1989 | Brown et al. | 405/262 |
| 4,856,939 A | * | 8/1989 | Hilfiker | 405/262 |
| 4,929,125 A | * | 5/1990 | Hilfiker | 405/262 |
| 4,960,349 A | * | 10/1990 | Willibey et al. | 405/262 |
| 5,395,185 A | * | 3/1995 | Schnabel, Jr. | 405/262 |
| 5,407,303 A | * | 4/1995 | Manns | 405/262 |
| 5,456,554 A | * | 10/1995 | Barrett et al. | 405/262 |
| 5,839,855 A | * | 11/1998 | Anderson et al. | 405/262 |
| 6,238,144 B1 | * | 5/2001 | Babcock | 405/262 |
| 6,315,499 B1 | * | 11/2001 | Kittson | 405/302.7 |
| 2001/0014255 A1 | | 8/2001 | Orsat | |

FOREIGN PATENT DOCUMENTS

| | | |
|---|---|---|
| DE | 202 15 715 U 1 | 4/2003 |
| EP | 1180561 A1 | 2/2002 |
| EP | 1 262 603 A1 | 12/2002 |
| FR | 2816648 A1 | 5/2002 |
| FR | 2 824 570 A3 | 11/2002 |
| GB | 2 334 739 A | 9/1999 |

OTHER PUBLICATIONS

Berg, et al.; Design, Construction and Performance of Two Geogrid Reinforced Soil Retaining Walls Conception; Slope Protection and Retaining Walls; Third International Conference on Geotextiles. 1986. Vienna, Austria.

* cited by examiner

*Primary Examiner*—Frederick L. Lagman
(74) *Attorney, Agent, or Firm*—Banner & Witcoff, Ltd.

(57) ABSTRACT

The stabilized earth or reinforced soil structure comprises a fill, a facing placed along a front face of the structure, main reinforcements disconnected from the facing and extending in a reinforced zone of the fill situated behind the front face, and secondary elements connected to the facing and extending in a zone of the fill which exhibits, with the reinforced zone, a common part where loads are transmitted between the main reinforcements and the secondary elements by the material of the fill.

17 Claims, 3 Drawing Sheets

FIG.2
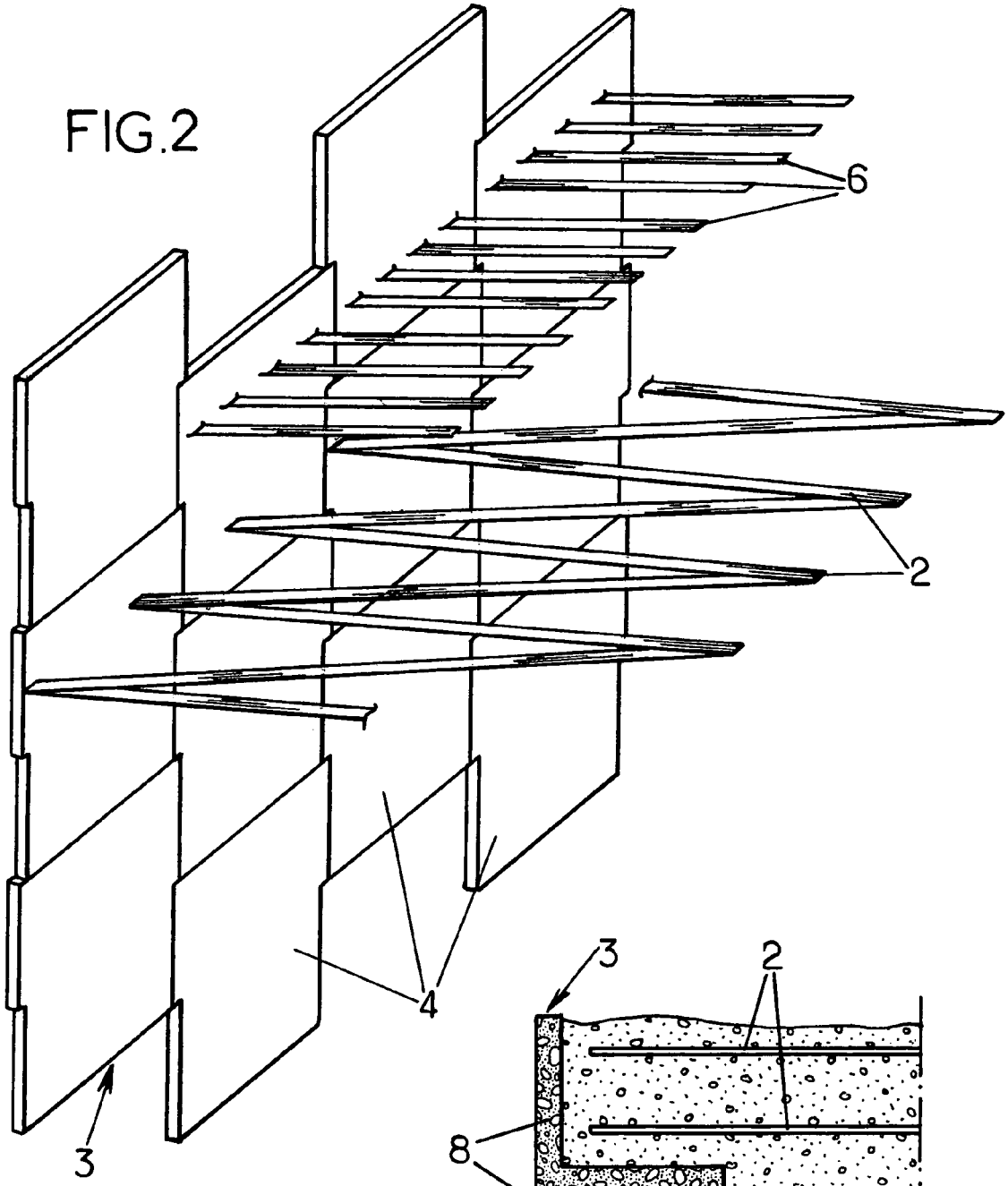
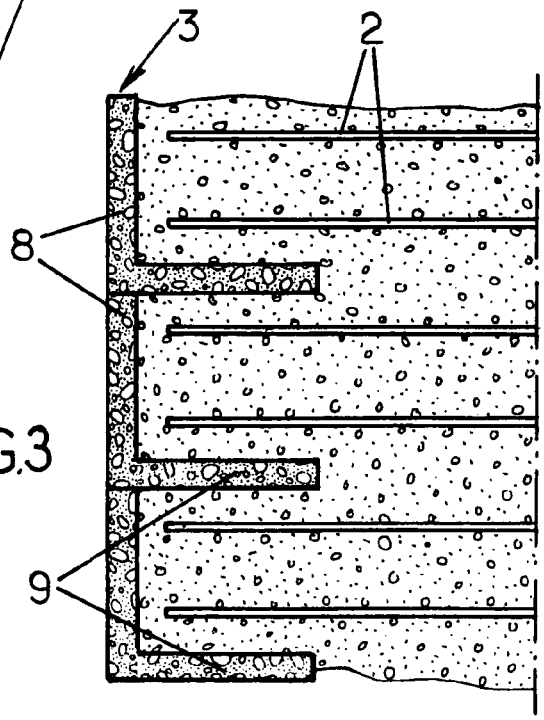
FIG.3

STABILIZED EARTH STRUCTURE AND METHOD FOR CONSTRUCTING IT

CROSS REFERENCE TO RELATED APPLICATION

This application claims priority to France Patent Application Ser. No. FR 03 11937, filed Oct. 13, 2003, which is incorporated herein by reference in its entirety.

BACKGROUND OF THE INVENTION

The present invention relates to the construction of stabilized earth, or reinforced soil, structures. This building technique is commonly used to produce structures such as retaining walls, bridge abutments, etc.

A stabilized earth structure combines a compacted fill, a facing and reinforcements usually connected to the facing.

Various types of reinforcement can be used: metal (for example galvanized steel), synthetic (for example based on polyester fibers), etc. They are placed in the earth with a density that is dependent on the stresses that might be exerted on the structure, the thrust of the soil being reacted by the friction between the earth and the reinforcements.

The facing is usually made from prefabricated concrete elements, in the form of slabs or blocks, juxtaposed to cover the front face of the structure. There may be horizontal steps on this front face between various levels of the facing, when the structure incorporates one or more terraces. In certain structures, the facing may be built in situ by pouring concrete or a special cement.

The reinforcements placed in the fill are secured to the facing by mechanical connecting members that may take various forms. Once the structure is completed, the reinforcements distributed through the fill transmit high loads, that may range up to several tons. Their connection to the facing needs therefore to be robust in order to maintain the cohesion of the whole.

These connections between the reinforcements and the facing are often weak points of the structure. There is a risk that the maximum load they can withstand may be exceeded if the soil undergoes differential settlement or in the event of an earthquake.

Furthermore, the connecting members exhibit risks of degradation. They are often sensitive to corrosion due to moisture or chemical agents present in or which have infiltrated into the fill. This disadvantage often prevents the use of metal connecting members. The connecting members are sometimes based on resins or composite materials so that they corrode less readily. However, their cost is then higher, and it is difficult to give them good mechanical properties without resorting to metal parts. For example, if the reinforcements are in the form of bands and attach by forming a loop behind a bar secured to the facing (U.S. Pat. No. 4,343,571, EP-A-1 114 896), such bar is stressed in bending, which is not ideal in the case of synthetic materials.

By construction, the prefabricated facing elements have a determined number of locations for connection to the reinforcements of the fill. This results in constraints on the overall design of the structure, particularly in terms of the density with which the reinforcements can be placed. For example, if the prefabricated elements each offer four attachment points, the designer will need to envisage connecting the reinforcements there that many times, or possibly a lower number of times, the number always being a whole number. If the structural engineering requires, for example, 2.5 pairs of main reinforcements per prefabricated element, it is necessary to provide a significant surplus of reinforcements, which has an significant impact on the cost. These considerations complicate the design of the structure, since the optimization generally requires reinforcement densities that can vary from one point in the fill to another.

An object of the present invention is to propose a novel method of connection between the facing and the reinforcements placed in the fill which, in certain embodiments at least, makes it possible to reduce the impact of the above-mentioned problems.

SUMMARY OF THE INVENTION

The invention thus proposes a stabilized soil or earth structure comprising a fill, main reinforcements extending through a reinforced zone of the fill situated behind a front face of the structure, and a facing placed along said front face. According to the invention, the main reinforcements are disconnected from the facing, and the structure further comprising secondary elements connected to the facing and extending in a zone of the fill which has, with said reinforced zone, a common part where loads are transmitted between the main reinforcements and the secondary elements by the material of the fill.

This stabilized earth structure has significant advantages. In particular, the structure may have good integrity in the presence of small soil movements. Such movements do not cause the reinforcements to tear away from the facing as in known structures, but may give rise to slight slippage between the main reinforcements and the secondary elements, through shearing of the fill material situated between them, thus avoiding irreversible damage to the structure. This advantage is particularly obtained when secondary elements extend in the fill up to a distance substantially shorter than the main reinforcements, with respect to the front face.

As the material of the fill contributes to the connecting of the main reinforcements to the secondary elements and therefore to the facing, they advantageously make it possible to avoid attaching to the main reinforcements mechanical connecting members that transmit the loads to the facing. It is thus possible to eliminate the corrosion or degradation problems often encountered with such connecting members in the prior art.

The structure according to the invention allows an overall design of the stabilized earth structure that separately and independently optimizes its two parts: (1) the facing and the secondary elements connected thereto, and (2) the zone reinforced by the main reinforcements.

The latter advantage in itself affords great benefit to the proposed structure, independently of the advantages mentioned hereinabove. The structure can be thought of as being made up of two stabilized soil massifs, one with the main reinforcements and the other with the secondary elements connected to the facing, these being nested together to give the whole its cohesion. Separate optimization of these two massifs affords an important economic gain.

Preferably, there is substantially no direct contact between the main reinforcements and the secondary elements. In a preferred embodiment of the structure, the facing comprises prefabricated elements in which the secondary elements are partly embedded. These prefabricated elements are typically made of concrete, it being possible for the secondary elements to consist of flexible synthetic reinforcing members each having at least one part cast into the concrete of one of the prefabricated elements. The facing may also comprise prefabricated elements each having at least one projecting portion forming one of the secondary elements. Such prefabricated elements have, for example, an L-shaped profile.

The invention can be applied to the repair of an existing structure, but its preferred application is that of the production of a new structure.

A second aspect of the invention thus relates to a method for building a stabilized earth structure, comprising the steps of positioning a facing along a front face of the structure delimiting a volume to be filled, placing main reinforcements in a zone of said volume, introducing fill material into said volume and compacting the fill material. According to the invention, the main reinforcements are not permanently connected to the facing, and secondary elements, connected to the facing, are installed in a zone of the volume to be filled which has a part in common with the zone in which the main reinforcements are placed, so that once the fill material has been introduced and compacted, loads are transmitted between the main reinforcements and the secondary elements by the fill material situated in said common part.

The facing is advantageously produced by assembling prefabricated elements. However, it can also be built in situ.

BRIEF DESCRIPTION THE DRAWINGS

FIG. 2 is a perspective part view of this structure.

FIG. 3 is a schematic view in lateral section of an alternative embodiment of a structure according to the invention.

DESCRIPTION OF PREFERRED EMBODIMENTS

Figure 1:
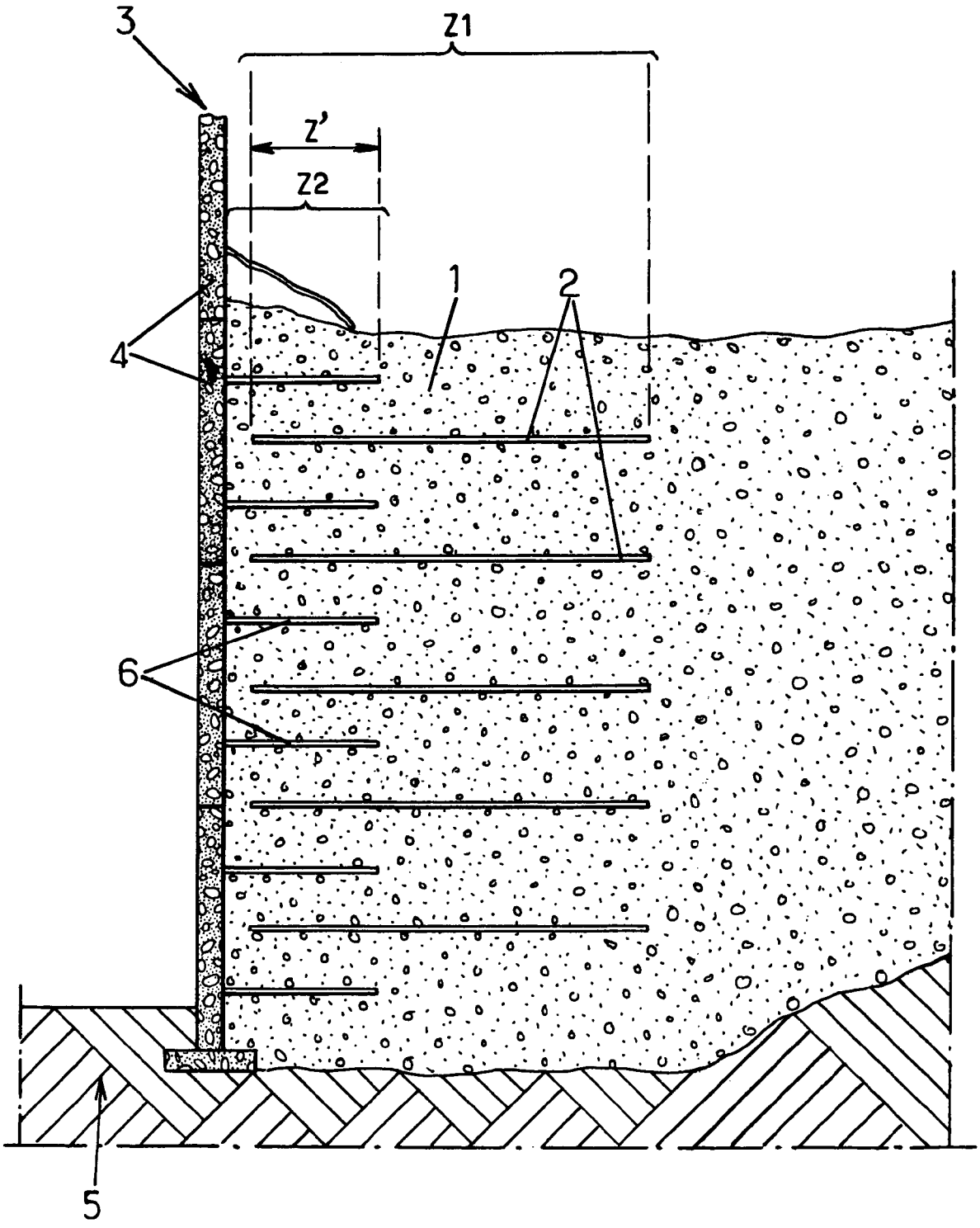
FIG. 1 is a schematic view in lateral section of a stabilized earth structure according to the invention, while it is being built.
Figure 4:
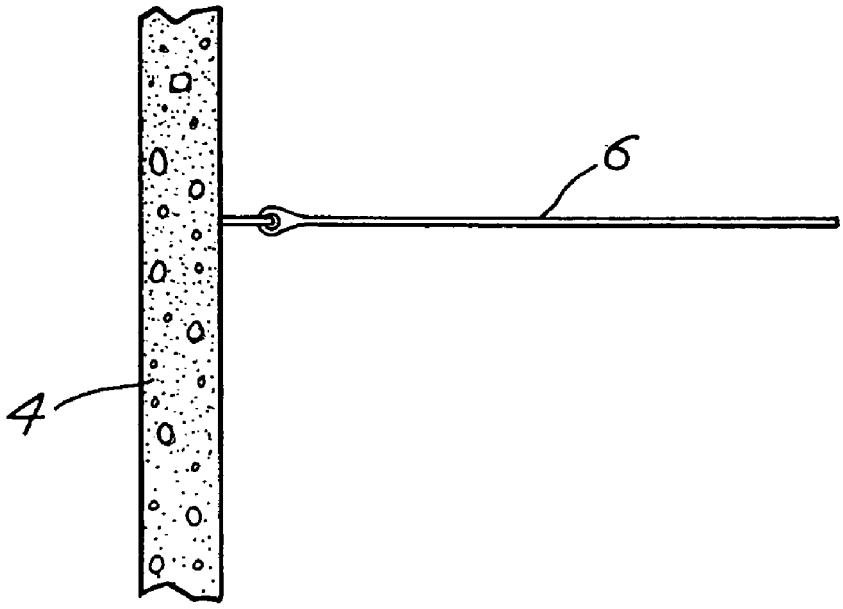
FIG. 4 is a schematic view in lateral section depicting a structure of the invention.

The figures illustrate the application of the invention to the building of a stabilized earth retaining wall. A compacted fill 1, in which main reinforcements 2 are distributed, is delimited on the front side of the structure by a facing 3 formed by juxtaposing prefabricated elements 4, in the form of slabs in the embodiment illustrated in FIGS. 1 and 2, and on the rear side by the soil 5 against which the retaining wall is erected.

In the example depicted (FIG. 2), main reinforcements 2 consist of synthetic reinforcing members in the form of bands following zigzag paths in horizontal planes behind the facing 3. These may in particular be the reinforcing bands marketed under the trade name "Paraweb".

FIG. 1 schematically shows the zone Z1 of the fill reinforced with the band-type reinforcing members 2.

The main reinforcements 2 are not positively connected to the facing 3, which dispenses with the need to attach them to specific connecting members. To ensure the cohesion of the retaining wall, secondary reinforcements or elements 6 are connected to the facing elements 4, and extend over a certain distance within the fill 1. These secondary reinforcements 6 contribute to reinforcing the earth in a zone Z2 situated immediately on the back of the facing 3.

The cohesion of the structure results from the fact that the reinforced zones Z1 and Z2 overlap in a common part Z'. In this common part Z', the material of the fill 1 has good strength because it is reinforced by both the reinforcements 2 and 6. It is thus able to withstand the shear stresses exerted as a result of the tensile loads experienced by the reinforcing members. This part Z' must naturally be thick enough to hold the facing 3 properly. In practice, a thickness of one to a few meters will generally suffice. By contrast, the main reinforcements 2 may extend far more deeply into the fill 1, as shown by FIG. 1. The simple connection of short reinforcements 6 to the back of the facing elements 4 thus allows the facing to be held pressed against fills which may be of large volume.

It is preferable to avoid contacts between the main reinforcements 2 and the secondary reinforcements 6 in the common part Z'. This is because no reliance is placed on the friction forces between reinforcements for reacting the tensile loads given that it is difficult to achieve full control over these friction forces. By contrast, in the stabilized earth technique, better control is had over the interfaces between reinforcing members and fill, which means that the strength properties of the reinforced fill stressed in shear can be relied upon.

In the example depicted, the secondary reinforcements 6 are also synthetic fiber-based bands. They may be connected to the facing 3 in various ways. They may be attached to the facing using conventional connecting members, for example of the kind described in EP-A-1 114 896.

In a preferred embodiment, these secondary reinforcements 6 are incorporated at the time of manufacture of the facing elements 4. In the frequent scenario where the elements 4 are prefabricated in concrete, part of the secondary reinforcements 6 may be embedded in the cast concrete of an element 4. This cast part may in particular form one or more loops around steel bars of the reinforced concrete of the elements 4, thus firmly securing them to the facing.

In the exemplary structure configuration illustrated by FIGS. 1 and 2, the main reinforcements 2 and the secondary reinforcements 6 are arranged in horizontal planes that are superposed in alternation over the height of the structure. Just two adjacent planes are shown in FIG. 2 in order to make it easier to read. As indicated earlier, the main reinforcements 2 are laid in a zigzag formation between two lines at which they are folded back. The distance between these two lines is dependent on the volume of the reinforced zone Z1. The pitch of the zigzag pattern depends on the reinforcement density required by the structural engineering calculations.

Still in the example of FIG. 2, secondary reinforcements 6 form a comb-like pattern in each horizontal plane in which they lie, the reinforcement band forming a loop inside a facing element 4 between two adjacent teeth of the comb.

In order to build the structure depicted in FIGS. 1 and 2, the procedure may be as follows:

a) placing some of the facing elements 4 so as to be able thereafter to introduce fill material over a certain depth. In a known way, the erection and positioning of the facing elements may be made easier by assembly members placed between them;

b) installing a main reinforcing band 2 on the fill already present, laying it in a zigzag pattern as indicated in FIG. 2. Slight tension is exerted between the two loop-back lines of the reinforcing band 2, for example using rods arranged along these lines and about which the band is bent at each loop-back point;

c) introducing fill material over the main reinforcing layer 2 which has just been installed, up to the next level of the secondary reinforcing members 6 on the rear side of the facing elements 4. This fill material is compacted as it is introduced;

d) placing on the fill the secondary reinforcements 6 situated at said level, exerting slight tension thereon;

e) introducing fill material over this level and progressively compacting it until the next specified level for the placement of main reinforcements 2 is reached;

f) repeating steps a) to e) until the upper level of the fill is reached.

It should be noted that numerous alternatives may be applied to the structure described hereinabove and to its method of production.

First, the main reinforcements 2 and the secondary elements 6 may adopt very diverse forms, as is done in the stabilized earth technique (synthetic band, metal bar, metal or synthetic grating in the form of a band, a layer, a ladder, etc), woven or non-woven geotextile layer, etc.

Likewise, all kinds of facings may be used: prefabricated elements in the form of slabs, blocks, etc, metal gratings, planters, etc. Furthermore, it is perfectly conceivable to build the facing 3 by casting it in situ using concrete or special cements, taking care to connect the secondary elements 6 therein.

In certain embodiments, secondary elements may be of one piece with the constituent elements of the facing 3. FIG. 3 schematically illustrates such an embodiment in which the facing 3 is made from prefabricated elements 8 each having an L-shaped profile: the upright part of the L extends along the front face of the structure to constitute the facing 3, while the other part of the L forms a secondary element 9 which projects into the reinforced fill 1 provided with the main reinforcements 2. A sufficient overlap Z' between the zone Z1 reinforced by the main reinforcements 2 and the zone Z2 into which the secondary elements 9 penetrate will then, as before, allow loads to be transmitted between the facing 3 and the reinforcements 2 via the material of the fill. Here again, it is appropriate to avoid placing the main reinforcements 2 in contact with the secondary elements 9.

The three-dimensional configurations adopted for the main reinforcements 2 and the secondary elements 6 within the fill 1 may also be very diverse: the patterns may be other than in zigzag or comb-shaped; it is possible to find main reinforcements 2 and secondary elements 6 in the same horizontal plane (preferably avoiding contact with one another); it is also possible to have, in the common part Z', a varying ratio between the density of the main reinforcements 2 and that of the secondary elements 6, 9; etc.

One of the significant advantages of the proposed structure is that it makes it possible to adopt very varied configurations and placement densities for the main reinforcements 2 and the secondary elements 6, 9, because the transmission of loads by the fill material situated between them eliminates most of the constructional constraints associated with the method of connection between the main reinforcements and the facing. It will thus be possible to find, within one and the same structure, regions where the relative densities of main reinforcements and/or of secondary elements 6 vary significantly, while they are optimized individually.

When the main reinforcement 2 is being placed on a level of the fill (step b above), it is possible to connect this reinforcement 2 to the facing by means of temporary attachments intended to break as the structure is gradually loaded with the overlying fill levels. Such temporary attachments, which are optional, make correct positioning of the main reinforcements easier, but are not relied upon to transmit load at the facing/fill interface once the structure is completed.

What is claimed is:

1. A stabilized earth structure comprising:

a fill with a front face;

a facing along said front face;

main stabilizing bands disconnected from the facing and extending through a first stabilized zone of the fill for stabilizing said first zone of said fill, said bands situated separate from, spaced from and behind said facing;

secondary stabilizing members connected to the facing and extending in a second stabilized zone of the fill stabilized by friction between the stabilizing members and said second zone of said fill, said second zone extending between the front face and partially into said first zone which has, with said first stabilized zone, a common part where loads are transmitted between the main stabilizing bands and the secondary members by only the material of the fill.

2. A structure according to claim 1, wherein the secondary members extend into the fill up to a distance substantially shorter than the main stabilizing bands, with respect to the front face.

3. A structure according to claim 1, wherein the facing comprises prefabricated elements in which the secondary members are partly embedded.

4. A structure according to claim 3, wherein the prefabricated elements are made of concrete and the secondary members comprise flexible synthetic stabilizing members each having at least one part cast into the concrete of one of the prefabricated elements.

5. The structure as claimed in claim 4, wherein the cast part of said flexible synthetic stabilizing member follows a loop within said one of the prefabricated elements, so that said flexible synthetic stabilizing member has two sections projecting into the second zone of the fill.

6. The structure as claimed in claim 4, wherein the flexible synthetic stabilizing members are bands.

7. A structure according to claim 1, wherein the facing comprises prefabricated elements each having at least one projecting portion forming one of the secondary members.

8. The structure as claimed in claim 1, wherein the main stabilizing bands are arranged along zigzag paths in the first zone.

9. A method for building a stabilized earth structure, comprising the steps of:

positioning a facing along a front face of the structure delimiting a volume to be filled, placing main mechanically stabilizing bands in a first zone of said volume, wherein the main stabilizing bands are not permanently connected to the facing and extend through the first zone, placing secondary mechanically stabilizing members connected to the facing in a second zone of said volume, said first and second zones having a part in common, and introducing fill material into said volume and compacting the fill material, whereby once the fill material has been introduced and compacted, loads are transmitted between the main stabilizing bands and the secondary members by only the fill material situated in said common part and each zone is mechanically stabilized by the stabilizing members or bands therein.

10. A method according to claim 9, wherein the secondary members are installed up to a distance substantially shorter than the main stabilizing bands with respect to the front face.

11. A method according to claim 9, wherein the facing comprises prefabricated elements incorporating secondary members.

12. A method according to claim 11, wherein the prefabricated elements are made of concrete and the secondary members comprise synthetic flexible stabilizing members each having at least one part cast into the concrete of one of the prefabricated elements.

13. A method according to claim 12, wherein the cast part of said flexible synthetic stabilizing member follows a loop within said one of the prefabricated elements, so that said flexible synthetic stabilizing member has two sections projecting into the second zone of the fill.

14. A method according to claim 11, wherein at least some of the prefabricated elements have at least one projecting portion forming one of the secondary elements.

15. The method as claimed in claim 9, wherein the step of placing the main stabilizing bands comprises arranging the main stabilizing bands along zigzag paths in the first zone.

16. The method as claimed in claim 9, further comprising the step of determining independently an optimal configuration and density of the main stabilizing bands in said first zone and an optimal configuration and density of the secondary members in said second zone.

17. The method as claimed in claim 9, further comprising the step of connecting at least some of the main stabilizing bands to the facing by means of temporary attachments designed to break in the step of introducing and compacting the fill material.

* * * * *